US011802393B2

(12) United States Patent
Tsukamoto

(10) Patent No.: US 11,802,393 B2
(45) **Date of Patent: *Oct. 31, 2023**

(54) SHOVEL

(71) Applicant: SUMITOMO (S.H.I.) CONSTRUCTION MACHINERY CO., LTD., Tokyo (JP)

(72) Inventor: Hiroyuki Tsukamoto, Chiba (JP)

(73) Assignee: SUMITOMO (S.H.I.) CONSTRUCTION MACHINERY CO., LTD., Tokyo (JP)

( * ) Notice: Subject to any disclaimer, the term of this patent is extended or adjusted under 35 U.S.C. 154(b) by 19 days.

This patent is subject to a terminal disclaimer.

(21) Appl. No.: 17/567,358

(22) Filed: Jan. 3, 2022

(65) Prior Publication Data

US 2022/0120058 A1 Apr. 21, 2022

Related U.S. Application Data

(60) Division of application No. 16/020,049, filed on Jun. 27, 2018, now Pat. No. 11,230,823, which is a continuation of application No. PCT/JP2016/088954, filed on Dec. 27, 2016.

(30) Foreign Application Priority Data

Dec. 28, 2015 (JP) ..... 2015-256681

(51) Int. Cl.
*E02F 9/26* (2006.01)
*E02F 9/20* (2006.01)

(52) U.S. Cl.
CPC ..... *E02F 9/261* (2013.01); *E02F 9/20* (2013.01); *E02F 9/26* (2013.01); *E02F 9/264* (2013.01); *E02F 9/2037* (2013.01)

(58) Field of Classification Search
CPC ... E02F 9/20; E02F 9/2037; E02F 9/26; E02F 9/261; E02F 9/264
See application file for complete search history.

(56) References Cited

U.S. PATENT DOCUMENTS

| | | | |
|---|---|---|---|
| 5,446,981 | A | 9/1995 | Kamada et al. |
| 5,854,988 | A | 12/1998 | Davidson et al. |
| 6,317,669 | B1 | 11/2001 | Kurenuma et al. |

(Continued)

FOREIGN PATENT DOCUMENTS

| | | |
|---|---|---|
| JP | S55-055732 | 4/1980 |
| JP | S62-185932 | 8/1987 |

(Continued)

OTHER PUBLICATIONS

International Search Report for PCT/JP2016/088954 dated Apr. 4, 2017.

*Primary Examiner* — Tyler J Lee
(74) *Attorney, Agent, or Firm* — IPUSA, PLLC

(57) ABSTRACT

A shovel includes a lower traveling body that runs; an upper rotating body that is rotatably mounted on the lower traveling body; an attachment attached to the upper rotating body; a display device; and a processor that obtains a current shape of a target ground, calculates a recommended line that is suitable to excavate, with the attachment, the target ground having the obtained current shape, and displays the current shape of the target ground and the recommended line on the display device.

12 Claims, 7 Drawing Sheets

(56) References Cited

U.S. PATENT DOCUMENTS

| | | | | |
|---|---|---|---|---|
| 9,043,098 | B2 | 5/2015 | Nomura et al. | |
| 10,161,111 | B2 | 12/2018 | Iwanaga et al. | |
| 2002/0063652 | A1 | 5/2002 | Price | |
| 2005/0027420 | A1 | 2/2005 | Fujishima et al. | |
| 2005/0150142 | A1* | 7/2005 | Matsuda | E02F 9/26 37/414 |
| 2007/0010925 | A1* | 1/2007 | Yokoyama | E02F 9/261 37/413 |
| 2010/0245542 | A1 | 9/2010 | Kim et al. | |
| 2013/0158784 | A1 | 6/2013 | Fukano et al. | |
| 2013/0158785 | A1 | 6/2013 | Fukano et al. | |
| 2013/0158786 | A1 | 6/2013 | Fukano et al. | |
| 2013/0158787 | A1 | 6/2013 | Nomura et al. | |
| 2013/0158797 | A1 | 6/2013 | Fukano et al. | |
| 2014/0099178 | A1 | 4/2014 | Nomura et al. | |
| 2014/0100744 | A1 | 4/2014 | Johnson et al. | |
| 2015/0330060 | A1 | 11/2015 | Seki et al. | |
| 2016/0217331 | A1 | 7/2016 | Kowatari et al. | |
| 2016/0244950 | A1 | 8/2016 | Kami et al. | |
| 2016/0376772 | A1 | 12/2016 | Kondo et al. | |
| 2017/0028922 | A1 | 2/2017 | Matsuo et al. | |
| 2017/0101761 | A1 | 4/2017 | Wu | |
| 2017/0175362 | A1 | 6/2017 | Iwanaga et al. | |
| 2018/0002899 | A1 | 1/2018 | Morimoto | |
| 2019/0211532 | A1 | 7/2019 | Sakamoto et al. | |
| 2020/0018045 | A1 | 1/2020 | Sano et al. | |

FOREIGN PATENT DOCUMENTS

| | | |
|---|---|---|
| JP | S63-194033 | 8/1988 |
| JP | H08-144317 | 6/1996 |
| JP | H08-333769 | 12/1996 |
| JP | 2000-291076 | 10/2000 |
| JP | 2003-056010 | 2/2003 |
| JP | 2004-514913 | 5/2004 |
| JP | 2012-172428 | 9/2012 |
| JP | 2012-172431 | 9/2012 |
| JP | 5426742 | 2/2014 |
| JP | 2014-148893 | 8/2014 |
| WO | 2015/162710 | 10/2015 |
| WO | 2015/194601 | 12/2015 |
| WO | 2016/148251 | 9/2016 |

* cited by examiner

SHOVEL

CROSS-REFERENCE TO RELATED APPLICATION

The present application is a divisional application of U.S. patent application Ser. No. 16/020,049 filed on Jun. 27, 2018, which is a continuation application filed under 35 U.S.C. 111(a) claiming benefit under 35 U.S.C. 120 and 365(c) of PCT International Application No. PCT/JP2016/088954, filed on Dec. 27, 2016, which is based on and claims the benefit of priority of Japanese Patent Application No. 2015-256681 filed on Dec. 28, 2015, the entire contents of which are incorporated herein by reference.

BACKGROUND OF THE INVENTION

1. Field of the Invention

An aspect of this disclosure relates to a shovel.

2. Description of the Related Art

An operator of a shovel operates various operation levers to move an attachment and thereby performs work such as excavation to, for example, change the shape of a work object into a target shape. In such excavation work, it is difficult for an operator to accurately excavate a work object into an exact target shape through visual observation.

There is a known display system for a hydraulic shovel. The display system displays a guide screen including a target surface line that is a line segment indicating a cross section of a target surface and based on positional information of a design surface indicating a target shape of a work object, an extension line obtained by extending the target surface line, and a position of the tip of a bucket.

Even when an operator performs work with a shovel including the known display system, the operator needs to determine how to start and carry out excavation work on an actual ground shape based on experience. For this reason, unless the operator is well-experienced, it may take much time to complete the excavation work and the work efficiency may become low.

SUMMARY OF THE INVENTION

In an aspect of this disclosure, there is provided a shovel including a lower traveling body that runs; an upper rotating body that is rotatably mounted on the lower traveling body; an attachment attached to the upper rotating body; a display device; and a processor that obtains a current shape of a target ground, calculates a recommended line that is suitable to excavate, with the attachment, the target ground having the obtained current shape, and displays the current shape of the target ground and the recommended line on the display device.

DESCRIPTION OF THE PREFERRED EMBODIMENTS

An aspect of this disclosure provides a shovel that can improve work efficiency.

Embodiments of the present invention are described below with reference to the accompanying drawings. The same reference number is assigned to the same component throughout the drawings, and repeated descriptions of the component may be omitted.

First Embodiment

Figure 1:
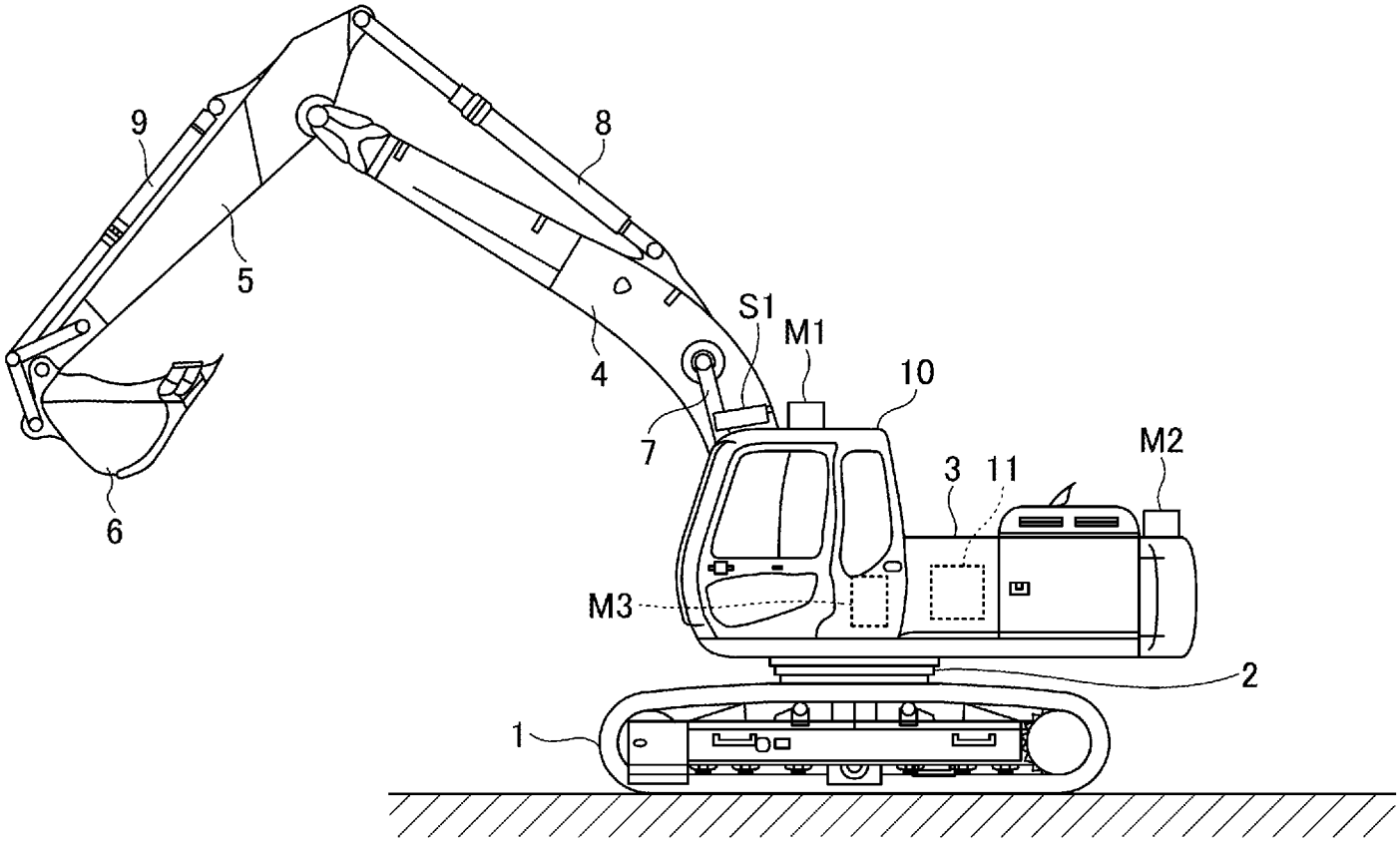
FIG. 1 is a side view of a shovel according to an embodiment.

First, a shovel according to an embodiment of the present invention is described. FIG. 1 is a side view of a shovel according to an embodiment of the present invention.

The shovel includes a lower traveling body 1 on which an upper rotating body 3 is mounted via a rotation mechanism 2. A boom 4 is attached to the upper rotating body 3. An arm 5 is attached to an end of the boom 4, and a bucket 6 is attached to an end of the arm 5. The boom 4, the arm 5, and the bucket 6 are hydraulically-driven by a boom cylinder 7, an arm cylinder 8, and a bucket cylinder 9, respectively. As work components, the boom 4, the arm 5, and the bucket 6 constitute an excavation attachment. The excavation attachment may be replaced with any other attachment such as a foundation-excavation attachment, a leveling attachment, or a dredging attachment.

The upper rotating body 3 includes a cabin and a power source such as an engine 11. A communication device M1, a positioning device M2, a posture detection device M3, and a front camera S1 are attached to the upper rotating body 3.

The communication device M1 controls communications between the shovel and external devices. In the present embodiment, the communication device M1 controls radio communications between a GNSS (global navigation satellite system) positioning system and the shovel. For example, the communication device M1 obtains topographical information of a work site once a day when shovel work is started. The GNSS positioning system employs, for example, a network RTK-GNSS positioning technique.

The positioning device M2 measures the position and the orientation of the shovel. In the present embodiment, the positioning device M2 is a GNSS receiver including an electronic compass, and measures the latitude, the longitude, and the altitude of the current position of the shovel as well as the orientation of the shovel.

The posture detection device M3 detects postures of attachment components such as the boom 4, the arm 5, and the bucket 6.

The front camera S1 is an imaging device that captures an image of a scene in front of the shovel. The front camera S1 captures an image of the shape of a ground after being excavated by an attachment.

Figure 2:
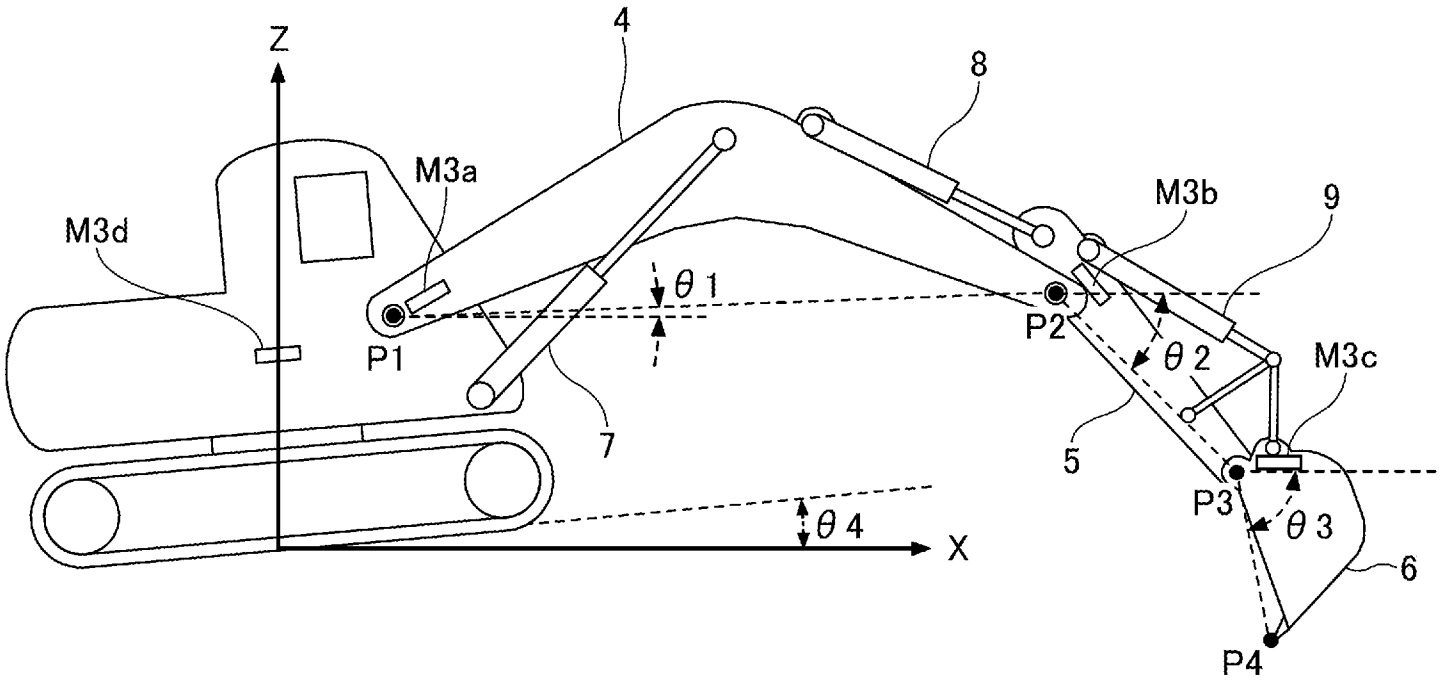
FIG. 2 is a side view of the shovel of FIG. 1 with examples of outputs of sensors constituting a posture detection device provided in the shovel.

FIG. 2 is a side view of the shovel of the present embodiment with examples of outputs of sensors constituting the posture detection device M3 provided in the shovel. Specifically, the posture detection device M3 includes a boom angle sensor M3*a*, an arm angle sensor M3*b*, a bucket angle sensor M3*c*, and a body inclination sensor M3*d*.

The boom angle sensor M3*a* obtains a boom angle θ1 and includes, for example, a rotation angle sensor for detecting a rotation angle of a boom foot pin, a stroke sensor for detecting the amount of stroke of the boom cylinder 7, and an inclination (acceleration) sensor for detecting an inclination angle of the boom 4. The boom angle θ1 is an angle between a line segment connecting a boom foot pin position P1 and an arm coupling pin position P2 and a horizontal line in an X-Z plane.

The arm angle sensor M3*b* obtains an arm angle θ2 and includes, for example, a rotation angle sensor for detecting a rotation angle of an arm coupling pin, a stroke sensor for detecting the amount of stroke of the arm cylinder 8, and an inclination (acceleration) sensor for detecting an inclination angle of the arm 5. The arm angle θ2 is an angle between a line segment connecting the arm coupling pin position P2 and a bucket coupling pin position P3 and a horizontal line in the X-Z plane.

The bucket angle sensor M3*c* obtains a bucket angle θ3 and includes, for example, a rotation angle sensor for detecting a rotation angle of a bucket coupling pin, a stroke sensor for detecting the amount of stroke of the bucket cylinder 9, and an inclination (acceleration) sensor for detecting an inclination angle of the bucket 6. The bucket angle θ3 is an angle between a line segment connecting the bucket coupling pin position P3 and a bucket tip position P4 and a horizontal line in the X-Z plane.

The body inclination sensor M3*d* obtains an inclination angle θ4 of the shovel around the Y-axis and an inclination angle θ5 (not shown) of the shovel around the X-axis, and includes, for example, a biaxial inclination (acceleration) sensor. An X-Y plane in FIG. 2 is a horizontal plane.

Figure 3:
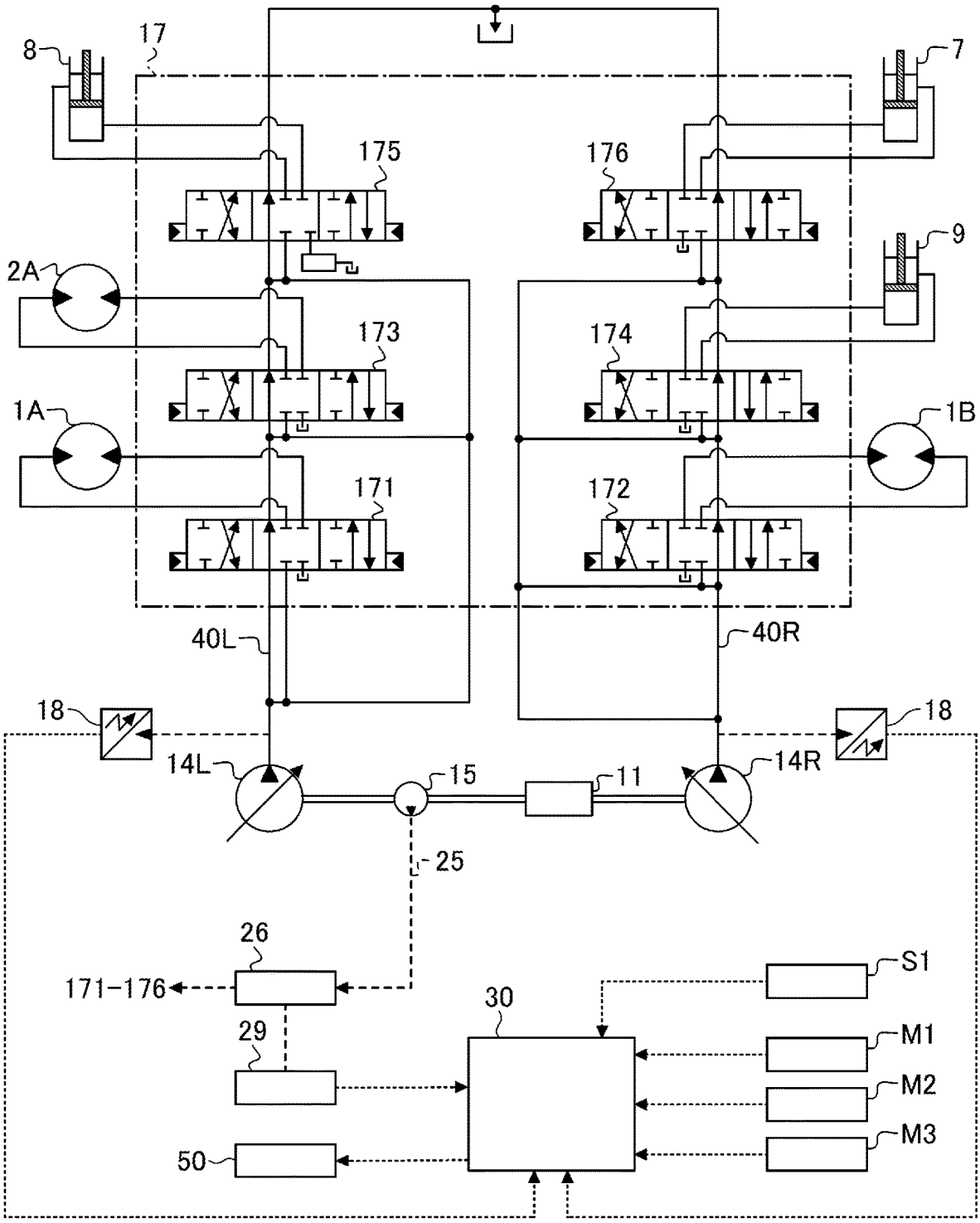
FIG. 3 is a drawing illustrating an example of a drive system provided in the shovel of FIG. 1.

FIG. 3 is a drawing illustrating an example of a configuration of a drive system provided in the shovel of the present embodiment. In FIG. 3, mechanical power transmission lines, high-pressure hydraulic lines, pilot lines, and electric control lines are represented by double lines, solid lines, dashed lines, and dotted lines, respectively.

The drive system of the shovel includes an engine 11, main pumps 14L and 14R, a pilot pump 15, a control valve system 17, an operation device 26, an operation detection device 29, and a controller 30.

The engine 11 is, for example, a diesel engine that is configured to maintain a predetermined engine speed. The output shaft of the engine 11 is connected to input shafts of the main pumps 14L and 14R and the pilot pump 15.

The main pumps 14L and 14R supply hydraulic oil via the high-pressure hydraulic lines to the control valve system 17 and may be implemented by, for example, variable-displacement swash-plate hydraulic pumps. The discharge pressure of the main pumps 14L and 14R is detected by a discharge pressure sensor 18. The discharge pressure sensor 18 outputs the detected discharge pressure of the main pumps 14L and 14R to the controller 30.

The pilot pump 15 supplies hydraulic oil via a pilot line 25 to hydraulic control devices including the operation device 26, and may be implemented by, for example, a fixed-displacement hydraulic pump.

The control valve system 17 is a hydraulic control device that controls the hydraulic system of the shovel. The control valve system 17 includes flow control valves 171-176 that control the flow of hydraulic oil discharged from the main pumps 14L and 14R. The control valve system 17 selectively supply the hydraulic oil discharged from the main pumps 14L and 14R via the flow control valves 171-176 to one or more of the boom cylinder 7, the arm cylinder 8, the bucket cylinder 9, a traveling hydraulic motor 1A (left), a traveling hydraulic motor 1B (right), and a rotating hydraulic motor 2A. In the descriptions below, the boom cylinder 7, the arm cylinder 8, the bucket cylinder 9, the traveling hydraulic motor 1A (left), the traveling hydraulic motor 1B (right), and the rotating hydraulic motor 2A are collectively referred to as "hydraulic actuators".

The operation device 26 is used by an operator to operate the hydraulic actuators. In the present embodiment, the operation device 26 supplies the hydraulic oil discharged from the pilot pump 15 via the pilot line 25 to pilot ports of the flow control valves corresponding to the hydraulic actuators. The pressure (pilot pressure) of the hydraulic oil supplied to each pilot port corresponds to the operation direction and the operation amount of a lever or a pedal (not shown) of the operation device 26 corresponding to one of the hydraulic actuators.

The operation detection device 29 detects operations performed by the operator using the operation device 26. In the present embodiment, the operation detection device 29 detects pressures representing the operation directions and the operation amounts of levers and pedals of the operation device 26 corresponding to the hydraulic actuators, and outputs the detected pressures to the controller 30. Operations performed using the operation device 26 may also be obtained based on outputs of sensors such as a potentiometer other than the pressure sensors.

The controller 30 is a control device for controlling the shovel and is implemented by, for example, a computer including a CPU, a RAM, and a nonvolatile memory. The controller 30 reads programs corresponding to various functional components from a ROM, loads the read programs into the RAM, and causes the CPU to perform processes corresponding to the functional components.

The controller 30 is connected to the discharge pressure sensor 18, a display device 50, the communication device M1, the positioning device M2, the posture detection device M3, and the front camera S1. The controller 30 performs calculations based on various types of data input from the discharge pressure sensor 18, the communication device N1, the positioning device M2, the posture detection device M3, and the front camera S1, and outputs calculation results to the display device 50.

The display device 50 is attached to, for example, a position in the cabin 10 where the operator can view a display screen, and displays the calculation results of the controller 30. The display device 50 may also be a wearable device integrated with, for example, a goggle worn by the operator. This improves the visibility of displayed information and enables the operator of the shovel to more efficiently carry out work.

Figure 4:
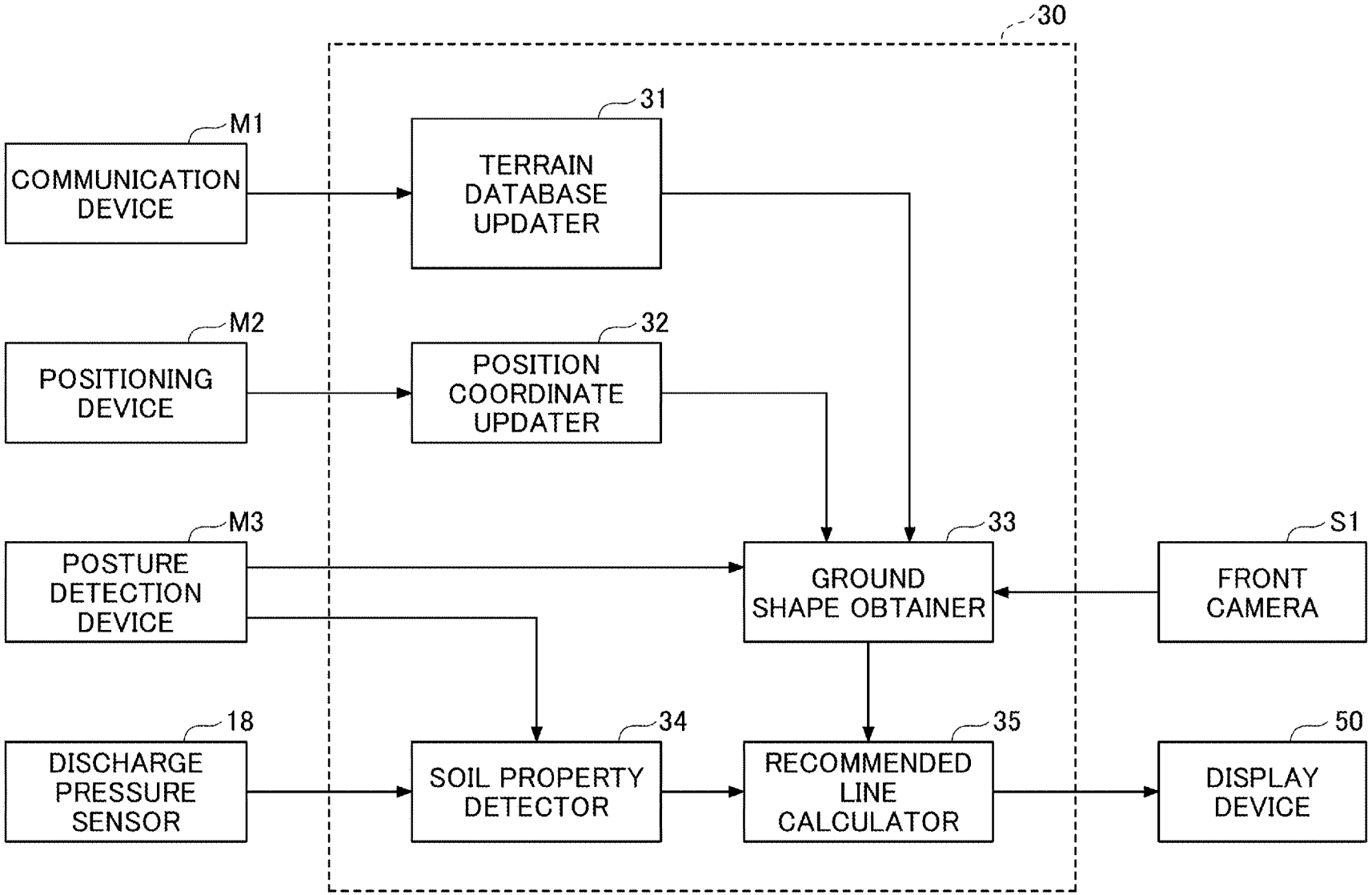
FIG. 4 is a functional block diagram illustrating an example of a configuration of a controller.

Next, functions of the controller 30 are described. FIG. 4 is a functional block diagram illustrating an example of a configuration of the controller 30.

As illustrated by FIG. 4, the controller includes a terrain database updater 31, a position coordinate updater 32, a ground shape obtainer 33, a soil property detector 34, and a recommended line calculator 35.

The terrain database updater 31 is a functional component that updates a terrain database containing browsable and systematic terrain information of work sites. In the present embodiment, the terrain database updater 31 obtains terrain information of a work site via the communication device M1 and updates the terrain database when, for example, the shovel is started. The terrain database is stored in, for example, a nonvolatile memory. Terrain information of work sites is described, for example, in a three-dimensional terrain model based on a world geodetic system.

The position coordinate updater 32 is a functional component that updates coordinates indicating the current position of the shovel and the orientation of the shovel. In the present embodiment, the position coordinate updater 32 obtains the positional coordinates and the orientation of the shovel in the world geodetic system based on an output of the positioning device M2, and updates coordinates indicating the current position of the shovel and data indicating the orientation of the shovel that are stored in, for example, a nonvolatile memory.

The ground shape obtainer 33 is a functional component that obtains information regarding the current shape of a target ground on which work is to be performed. In the present embodiment, the ground shape obtainer 33 obtains an initial shape of a target ground before being excavated from the terrain information updated by the terrain database updater 31 based on the coordinates indicating the current position of the shovel and the orientation of the shovel that are updated by the position coordinate updater 32.

Also, the ground shape obtainer 33 calculates a current shape of the target ground after being excavated by the shovel based on the past transition of the posture of an attachment detected by the posture detection device M3. The ground shape obtainer 33 may also be configured to calculate the current shape of the target ground after being excavated by the shovel based on an image of the excavated target ground captured by the front camera S1. Further, the ground shape obtainer 33 may be configured to calculate the current shape of the excavated target ground based on both of the past transition of the posture of the attachment detected by the posture detection device M3 and image data of the excavated target ground captured by the front camera S1.

Thus, the ground shape obtainer 33 obtains an initial shape of the target ground before being excavated by the shovel and calculates a current shape of the excavated target ground each time excavation is performed by the shovel. For example, the ground shape obtainer 33 calculates a current shape of the excavated target ground after each excavation cycle where the boom 4 descends and the arm 5 and the bucket 6 rotate to excavate the target ground and then the boom 4 ascends.

The soil property detector 34 is a functional component that detects the soil property of the target ground. The soil property detector 34 detects the soil property of the target ground based on a discharge pressure of the main pumps 14L and 14R output from the discharge pressure sensor 18 during excavation. The soil property detector 34 determines whether the bucket 6 is in contact with the target ground and excavation is being performed based on the posture of the attachment detected by the posture detection device M3, and detects the soil property based on a discharge pressure output from the discharge pressure sensor 18.

For example, when the target ground is sandy soil, high output horsepower is not necessary to excavate the target ground. In this case, the main pumps 14L and 14R are controlled so that their output horsepower becomes low, and as a result the discharge pressure of the main pumps 14L and 14R becomes low. The soil property detector 34 determines that the target ground is sandy soil when the discharge pressure of the main pumps 14L and 14R detected by the discharge pressure sensor 18 during excavation is less than a predetermined threshold.

As another example, when the target ground is cohesive soil, high output horsepower is necessary to excavate the target ground. In this case, the main pumps 14L and 14R are controlled so that their output horsepower becomes high, and as a result the discharge pressure of the main pumps 14L and 14R becomes high. The soil property detector 34 determines that the target ground is cohesive soil when the discharge pressure of the main pumps 14L and 14R detected by the discharge pressure sensor 18 during excavation is greater than or equal to the predetermined threshold.

The soil property detector 34 may also be configured to detect, for example, gravelly soil in addition to sandy soil and cohesive soil based on a discharge pressure of the main pumps 14L and 14R detected by the discharge pressure sensor 18. Further, the soil property detector 34 may be configured to detect the soil property of a target ground based on one or more of a boom cylinder pressure, an arm cylinder pressure, and a bucket cylinder pressure detected during excavation.

The recommended line calculator 35 is a functional component that calculates a recommended line suitable to excavate the target ground with a current shape that is obtained or calculated by the ground shape obtainer 33. The recommended line calculator 35 calculates a recommended line suitable to excavate the target ground with a current shape based on the capacity of the bucket 6 as an attachment and the soil property of the target ground detected by the soil property detector 34. In the present embodiment, the recommended line is represented by a trace of the tip of the bucket 6.

The recommended line calculator 35 defines a recommended line by an excavation depth and an excavation length. For example, when the target ground is sandy soil, excavation work where the bucket 6 is inserted deep into the ground and rotated can be performed with low horsepower. For this reason, when the target ground is sandy soil, the recommended line calculator 35 calculates a recommended line such that the excavation depth becomes large and the excavation length becomes short. The excavation depth and the excavation length are obtained based on, for example, the capacity and the maximum load of the bucket 6.

As another example, when the target ground is cohesive soil, excavation work where the bucket 6 is inserted deep into the ground and rotated may require high horsepower and reduce energy efficiency. For this reason, when the target ground is cohesive soil, the recommended line calculator 35 calculates a recommended line such that the excavation depth becomes smaller and the excavation length becomes longer compared with a case where the target ground is sandy soil.

Each time excavation is performed by the shovel, the recommended line calculator 35 calculates a recommended line for the current shape of the excavated target ground. As described above, when one excavation cycle is performed by the shovel, the ground shape obtainer 33 calculates a current shape of the excavated target ground. When the current shape of the excavated target ground is calculated by the ground shape obtainer 33, the recommended line calculator 35 calculates a recommended line suitable to excavate the target ground with the calculated current shape.

Also, the recommended line calculator 35 calculates an attachment posture such as an angle of the bucket 6 suitable to perform excavation along the calculated recommended line. For example, the recommended line calculator 35 calculates an angle of the bucket 6 for performing excavation along the recommended line. Further, the recommended line calculator 35 may be configured to also calculate angles of the boom 4 and the arm 5 suitable to perform excavation along the recommended line.

The recommended line calculator 35 outputs, to the display device 50, the current shape of the target ground obtained or calculated by the ground shape obtainer 33, the recommended line for the current shape of the target ground, and the angle of the bucket 6 for performing excavation along the recommended line.

The display device 50 displays, on a screen, the current shape of the target ground and the recommended line output from the recommended line calculator 35. Also, the display device 50 displays, on the screen, the current position of the attachment detected by the posture detection device M3 and the angle of the bucket 6 for performing excavation along the recommended line.

Figure 5:
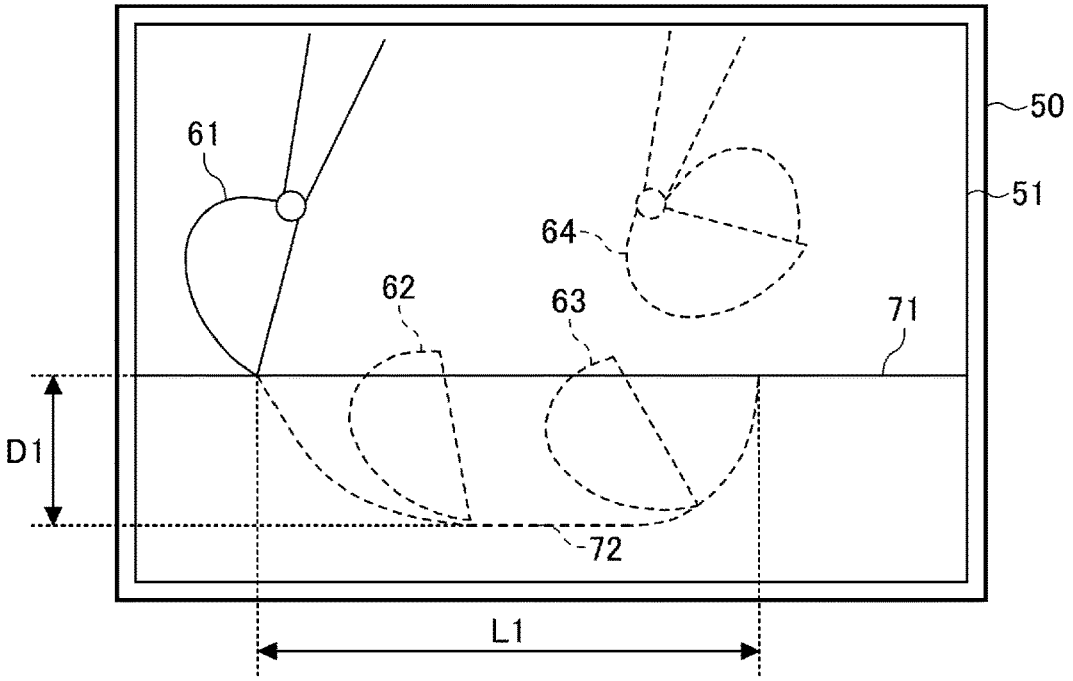
FIG. 5 is a drawing illustrating an example of an image displayed on a display device when sandy soil is excavated.

FIG. 5 illustrates an example of an image displayed by the display device 50. FIG. 5 illustrates an example of the image 51 that is displayed when sandy soil is excavated. In the image of FIG. 5, a current bucket position 61 indicating the current position of the bucket 6 and a current shape 71 of the target ground are displayed by solid lines.

When the attachment of the shovel is operated by the operator and the tip of the bucket 6 is inserted into the target ground, the soil property detector 34 detects the soil property of the target ground and the recommended line calculator 35 calculates a recommended line. The recommended line calculator 35 also calculates an angle of the bucket 6 for performing excavation along the recommended line. When the recommended line and the angle of the bucket 6 are calculated by the recommended line calculator 35, a recommended line 72 for the current shape 71 of the target ground is displayed by a dashed line as illustrated in FIG. 5. Also, bucket excavation positions 62, 63, and 64 during excavation along the recommended line 72 are displayed by dashed lines as excavation positions of the attachment.

When the operator operates the attachment, based on detection results of the posture detection device M3, the current bucket position 61 displayed in the image 51 changes along with the actual movement of the bucket 6. While viewing the image 51 displayed on the display device 50, the operator operates the attachment such that the bucket 6 moves along the recommended line 72. Also, the operator rotates the bucket 6 to match the angles indicated by the bucket excavation positions 62, 63, and 64.

When the operator operates the attachment and completes one excavation cycle by performing excavation along the recommended line 72 and lifting the boom 4, the current shape 71 of the ground in the image 51 is updated to a shape of the excavated ground. The shape of the excavated ground is calculated by the ground shape obtainer 33 based on at least one of the past transition of the posture of the attachment detected by the posture detection device M3 and an image of the excavated ground captured by the front camera S1.

Also, the recommended line calculator 35 calculates a recommended line for the current shape of the excavated ground, and the recommended line 72 displayed in the image 51 is updated. The operator of the shovel can continue the excavation work while viewing the current shape 71 of the ground and the recommended line 72 that are displayed in the image and updated each time excavation is performed with the attachment.

Thus, the operator of the shovel can quickly and efficiently perform work by operating the attachment to excavate the target ground along a recommended line while viewing the image 51 displayed on the display device 50.

Figure 6:
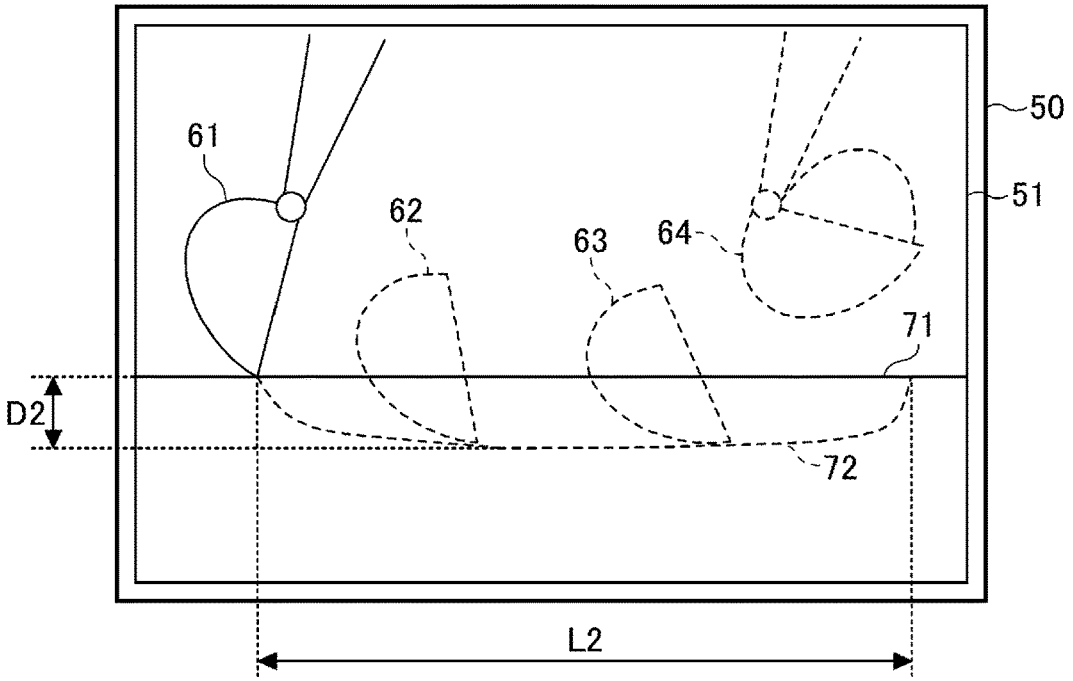
FIG. 6 is a drawing illustrating an example of an image displayed on a display device when cohesive soil is excavated.

FIG. 6 is a drawing illustrating an example of an image 51 displayed on the display device 50 when cohesive soil is excavated. If cohesive soil is excavated by inserting the bucket 6 deep into the ground and rotating the bucket 6 as in the case where sandy soil is excavated, high horsepower is necessary and energy efficiency is reduced. For this reason, when the soil property detector 34 detects that the target ground is cohesive soil, the recommended line calculator 35 calculates a recommended line such that an excavation depth D2 becomes smaller (D2<D1) and an excavation length L2 becomes longer (L2>L1) compared with the case (FIG. 5) where the target ground is sandy soil.

Also in the case where the target ground is cohesive soil, when one excavation cycle is completed by performing excavation along the recommended line 72 and lifting the boom 4, the current shape 71 of the ground and the recommended line 72 displayed in the image 51 are updated.

Thus, displaying a recommended line corresponding to the soil property of the target ground makes it possible to prevent the operator from inserting the bucket 6 deep into the ground more than necessary and reducing the fuel efficiency, and makes it possible to efficiently perform excavation work depending on the soil property of the target ground.

As described above, in the shovel of the present embodiment, a current shape of a target ground and a recommended line suitable for excavating the target ground are displayed on the display device 50 together with the current position of the bucket 6. With this configuration, an operator of the shovel can efficiently perform excavation work without having expertise by simply performing excavation along a recommended line.

Second Embodiment

In the first embodiment, the current shape of a ground is updated and a next recommended line is calculated and displayed each time an attachment is operated by an operator and excavation is performed. In contrast, in a second embodiment, when multiple excavation cycles need to be performed to reach the vicinity of a target surface, recommended lines for the multiple excavation cycles are calculated in advance and displayed simultaneously. This configuration enables an operator to easily determine how many excavation cycles need to be performed to reach the vicinity of the target surface.

Figure 7:
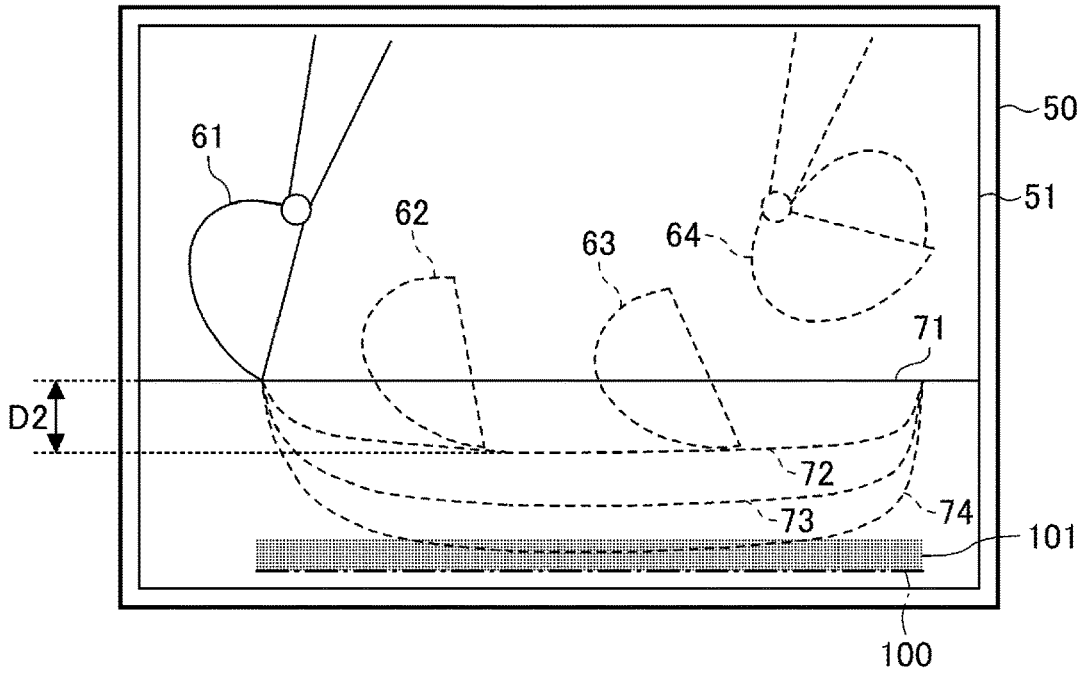
FIG. 7 is a drawing illustrating an example of an image displayed on a display device when sandy soil is excavated through multiple cycles.

FIG. 7 is a drawing illustrating an example of an image displayed on a display device when sandy soil is excavated through multiple cycles. Similarly to FIG. 5, in an image 51 of FIG. 7, a current bucket position 61 indicating the current position of the bucket 6 and a current shape 71 of the target ground are displayed by solid lines.

When the attachment of the shovel is operated by the operator and the tip of the bucket 6 is inserted into the target ground, the soil property detector 34 detects the soil property of the target ground. Also, the recommended line calculator 35 calculates a first recommended line for a first excavation cycle. The recommended line calculator 35 also calculates an angle of the bucket 6 for performing excavation along the first recommended line.

When the first recommended line and the angle of the bucket 6 are calculated by the recommended line calculator 35, a first recommended line 72 for the current shape 71 of the target ground is displayed by a dashed line as illustrated in FIG. 7. Also, bucket excavation positions 62, 63, and 64 during excavation along the recommended line 72 are displayed by dashed lines as excavation positions of the attachment.

Here, it is assumed that the position of a target surface 100 is set in the recommended line calculator 35 beforehand. After calculating the first recommended line 72, the recommended line calculator 35 determines whether the calculated first recommended line 72 is included in a vicinity area 101 near the target surface 100. The vicinity area 101 is determined based on, for example, the excavation depth D2 per cycle.

When the calculated first recommended line 72 is not included in the vicinity area 101, the recommended line calculator 35 calculates a second recommended line 73 for a second excavation cycle. After calculating the second recommended line 73, the recommended line calculator 35 determines whether the calculated second recommended line 73 is included in the vicinity area 101 near the target surface 100.

When the calculated second recommended line 73 is not included in the vicinity area 101, the recommended line calculator 35 further calculates a third recommended line 74 for a third excavation cycle. After calculating the third recommended line 74, the recommended line calculator 35 determines whether the calculated third recommended line 74 is included in the vicinity area 101 near the target surface 100.

When the calculated third recommended line 74 is included in the vicinity area 101, the recommended line calculator 35 displays the second and third recommended lines 73 and 74 by dashed lines in addition to the first recommended line 72.

Thus, with the second embodiment, an operator can easily determine the number of excavation cycles that need to be performed to reach the vicinity of the target surface by viewing displayed recommended lines before starting excavation.

Also, as illustrated in FIG. 7, the recommended line calculator 35 may also display the target surface 100 and the vicinity area 101. Further, the recommended line calculator 35 may display the number of excavation cycles.

Third Embodiment

In the first embodiment, a recommended line is calculated based on a soil property. However, parameters used to calculate recommended lines are not limited to soil properties, and recommended lines may be calculated based also on parameters other than soil properties. In a third embodiment, the size, shape, and position of a buried object are taken into account in calculating a recommended line in addition to a soil property.

Figure 8:
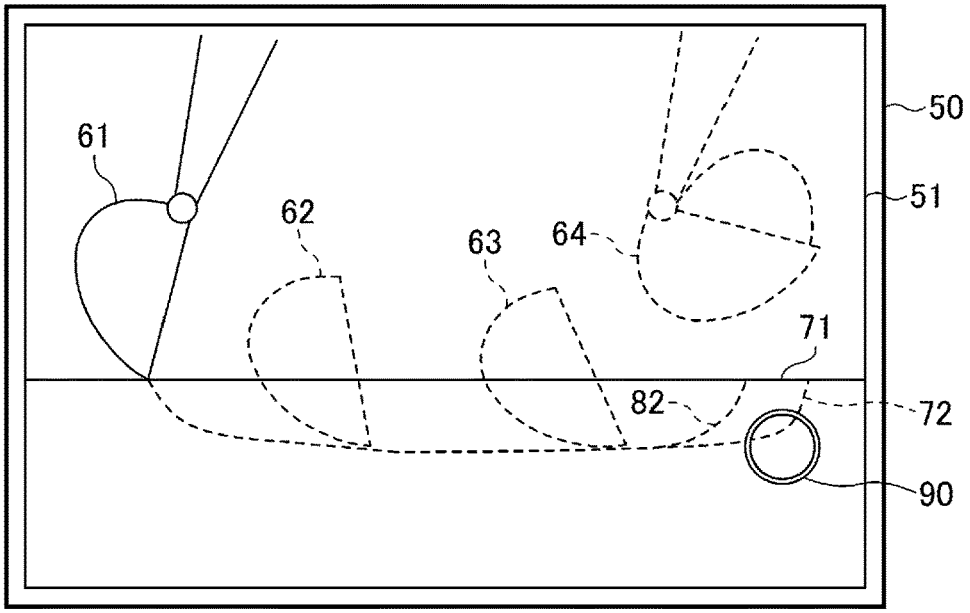
FIG. 8 is a drawing illustrating an example of an image displayed on a display device when sandy soil is excavated taking into account a buried object.

FIG. 8 is a drawing illustrating an example of an image displayed on a display device when sandy soil is excavated taking into account a buried object. Similarly to FIG. 5, in an image 51 of FIG. 8, a current bucket position 61 indicating the current position of the bucket 6 and a current shape 71 of the target ground are displayed by solid lines.

When the attachment of the shovel is operated by the operator and the tip of the bucket 6 is inserted into the target ground, the soil property detector 34 detects the soil property of the target ground. Here, it is assumed that the size, shape, and position of an underground buried object are registered beforehand in the recommended line calculator 35. When a soil property is detected by the soil property detector 34, the recommended line calculator 35 of the present embodiment calculates a recommended line based on the soil property such that the recommended line does not interfere with the buried object.

A recommended line 82 in FIG. 8 is calculated by the recommended line calculator 35 based on the size, shape, and position of the buried object and the detected soil property. For comparison, FIG. 8 also illustrates a recommended line 72 that is calculated without taking into account the size, shape, and position of the buried object.

As illustrated in FIG. 8, the recommended line 72 calculated without taking into account the size, shape, and position of the buried object interferes with a buried object 90. In contrast, the recommended line 82 calculated taking into account the size, shape, and position of the buried object does not interfere with the buried object 90.

Thus, the third embodiment makes it possible to calculate and display a recommended line that does not interfere with an underground buried object.

As illustrated in FIG. 8, the recommended line calculator 35 may be configured to generate an image of the buried object 90 based on the pre-registered size, shape, and position of the buried object 90, and display the generated image in the image 51.

Fourth Embodiment

In the above embodiments, the position of the tip of the bucket 6 in a side view of excavation work is displayed as a recommended line together with bucket excavation positions. In contrast, in a fourth embodiment, the position of the tip of the bucket 6 in a top view of excavation work is displayed as a recommended line together with bucket excavation positions and rotation directions (rotation angles) of the upper rotating body 3.

In general, when performing excavation work such as grid excavation, the operator rotates the upper rotating body 3 in each cycle so that a blade edge of the bucket 6 is positioned on a predetermined line.

For this reason, the recommended line calculator 35 of the present embodiment displays a top view image of excavation work such as grid excavation. The displayed image includes a recommended line indicating the position of a blade edge of the bucket 6, and bucket excavation positions and rotation directions (and rotation angles) of the upper rotating body 3 for respective cycles.

Figure 9:
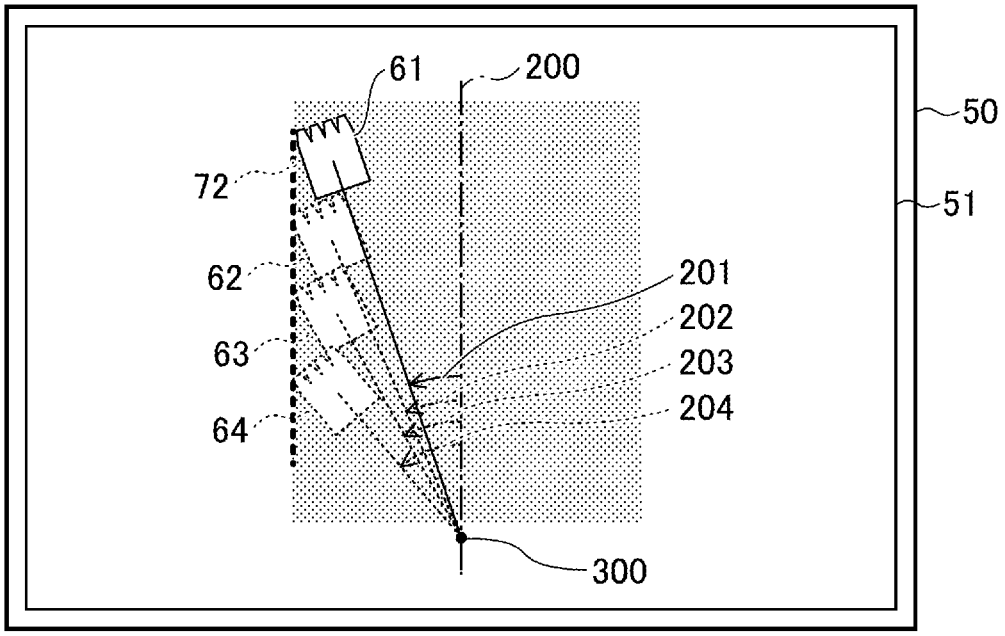
FIG. 9 is a drawing illustrating an example of a top view image of excavation work.

FIG. 9 is a drawing illustrating an example of a top view image of excavation work. An image 51 in FIG. 9 includes a recommended line 72 indicating the position of the blade edge of the bucket 6. Also, in the image 51, a current bucket position 61 indicating the current position of the bucket 6 and a rotation direction 201 of the current bucket position 61 around a rotation center 300 with respect to a reference direction 200 are displayed by solid lines. In addition to the rotation direction 201, a rotation angle of the current bucket position 61 with respect to the reference direction 200 may be displayed.

Also, in the image 51, bucket excavation positions 62, 63, and 64 during excavation along the recommended line 72 in respective cycles are displayed by dotted lines. Further, rotation directions 202-204 of the bucket excavation positions 62, 63, and 64 around the rotation center 300 with respect to the reference direction 200 are displayed by dotted lines. Rotation angles of the bucket excavation positions 62, 63, and 64 with respect to the reference direction 200 may also be displayed.

Displaying a recommended line and other information items in a top view image of excavation work in addition to displaying a recommended line and other information items in a side view image of the excavation work as described above enables an operator of the shovel to efficiently perform the excavation work.

A shovel according to embodiments of the present invention are described above. However, the present invention is not limited to the specifically disclosed embodiments, and variations and modifications may be made without departing from the scope of the present invention.

What is claimed is:

1. A shovel, comprising:

a lower traveling body that runs;

an upper rotating body that is rotatably mounted on the lower traveling body;

an attachment attached to the upper rotating body; and a controller including a memory and a processor configured to control the shovel, wherein the processor calculates a rotation angle of the upper rotating body such that one of right and left edges of a bucket included in the attachment is positioned on a target surface or a recommended line.

2. The shovel as claimed in claim 1, further comprising:

a display device configured to display an image of a top view of the attachment.

3. The shovel as claimed in claim 1, wherein each time a target ground is excavated with the attachment, the display device is configured to update and display a recommended line that is calculated by the processor based on a shape of the excavated target ground.

4. The shovel as claimed in claim 1, wherein the processor calculates the recommended line for the shape of the target ground excavated with the attachment.

5. The shovel as claimed in claim 1, wherein the display device is configured to display an image of a side view of the attachment in addition to the image of the top view of the attachment.

6. A shovel, comprising:

a lower traveling body that runs;

an upper rotating body that is rotatably mounted on the lower traveling body;

an attachment attached to the upper rotating body; and a controller including a memory and a processor configured to execute obtaining a current shape of a target ground, and calculating a recommended line that is suitable to excavate, with the attachment, between a top surface of the current shape of the target ground obtained by the obtaining, and a target that is apart from and below the top surface of the current shape of the target ground.

7. The shovel as claimed in claim 6, wherein each time the target ground is excavated with the attachment, the processor updates a recommended line that is calculated by the calculating based on a shape of the excavated target ground.

8. The shovel as claimed in claim 6, wherein the processor calculates the recommended line for the shape of the target ground excavated with the attachment.

9. The shovel as claimed in claim 6, wherein the processor obtains a shape of the excavated target ground based on at least one of an image of an excavated portion of the target ground captured by an imaging device and a transition of a posture of the attachment.

10. A method of controlling a shovel that includes a lower traveling body that runs, an upper rotating body that is rotatably mounted on the lower traveling body, and an attachment attached to the upper rotating body, the method executed by a controller including a memory and a processor, comprising:

obtaining a current shape of a target ground; and calculating a recommended line that is suitable to excavate, with the attachment, between a top surface of the current shape of the target ground obtained by the obtaining, and a target that is apart from and below the top surface of the current shape of the target ground.

11. The method of controlling the shovel as claimed in claim 10, wherein the calculating calculates, each time the target ground is excavated with the attachment, a recommended line based on a shape of the excavated target ground.

12. The method of controlling the shovel as claimed in claim 10, wherein the calculating calculates the recommended line for the shape of the target ground excavated with the attachment.

* * * * *